US009259928B2

(12) United States Patent
Torimoto et al.

(10) Patent No.: US 9,259,928 B2
(45) Date of Patent: Feb. 16, 2016

(54) LIQUID EJECTING HEAD AND LIQUID EJECTING APPARATUS

(71) Applicant: Seiko Epson Corporation, Tokyo (JP)

(72) Inventors: Tatsuro Torimoto, Matsumoto (JP); Kazushige Hakeda, Shiojiri (JP); Tadao Furuta, Shiojiri (JP); Motoki Takabe, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/663,063

(22) Filed: Mar. 19, 2015

(65) Prior Publication Data

US 2015/0217567 A1 Aug. 6, 2015

Related U.S. Application Data

(63) Continuation of application No. 14/224,013, filed on Mar. 24, 2014, now Pat. No. 9,022,527.

(30) Foreign Application Priority Data

Mar. 27, 2013 (JP) ..... 2013-065757

(51) Int. Cl.

| | |
|---|---|
| ***B41J 2/045*** | (2006.01) |
| ***B41J 2/14*** | (2006.01) |
| ***B41J 2/16*** | (2006.01) |

(52) U.S. Cl.

CPC ..... *B41J 2/14201* (2013.01); *B41J 2/14233* (2013.01); *B41J 2/161* (2013.01); *B41J 2/1618* (2013.01); *B41J 2/1628* (2013.01); *B41J 2/1632* (2013.01); *B41J 2/1646* (2013.01); *B41J 2002/14241* (2013.01); *B41J 2002/14419* (2013.01); *B41J 2002/14491* (2013.01)

(58) Field of Classification Search

CPC ..... B41J 2/14201; B41J 2/14233; B41J 2/14241; B41J 2/14274; B41J 2001/14266; B41J 2002/14306; B41J 2/14072; B41J 2002/14491; B41J 2/26; B41J 2202/18; B41J 2/16; B41J 2/1607; B41J 2/1618; B41J 2/1623

See application file for complete search history.

(56) References Cited

U.S. PATENT DOCUMENTS

| | | | | |
|---|---|---|---|---|
| 9,022,527 | B2 * | 5/2015 | Torimoto et al. | 347/50 |
| 2010/0097428 | A1 | 4/2010 | Owaki | |
| 2011/0018943 | A1 | 1/2011 | Owaki | |

FOREIGN PATENT DOCUMENTS

| | | | |
|---|---|---|---|
| JP | 2011-025493 | A | 2/2011 |

OTHER PUBLICATIONS

Non-Final Rejection of Aug. 28, 2014 in related U.S. Appl. No. 14/224,013—12 pages.

Notice of Allowance of Dec. 24, 2014 in related U.S. Appl. No. 14/224,013—7 pages.

* cited by examiner

*Primary Examiner* — Geoffrey Mruk

(57) ABSTRACT

A liquid ejecting head includes a pressure element that applies a pressure to a pressure chamber which communicates with a nozzle which ejects a liquid, and a lead electrode that is joined to a wiring substrate which supplies a driving signal which drives the piezoelectric element, and the pressure element, in which a surface of the lead electrode on the wiring substrate side in a connection region between the lead electrode and the wiring substrate becomes a concavo-convex surface, in which the lead electrode and the wiring substrate are fixed to each other at a periphery of the connection region and at least one portion of a concave portion of the concavo-convex surface of the lead electrode with a non-conductive paste, and in which the lead electrode and the wiring substrate are electrically connected to each other at a convex portion of the concavo-convex surface of the lead electrode on which the non-conductive paste is not present.

8 Claims, 7 Drawing Sheets

LIQUID EJECTING HEAD AND LIQUID EJECTING APPARATUS

CROSS REFERENCE TO RELATED APPLICATIONS

This application is a continuation of U.S. application Ser. No. 14/224,013 filed Mar. 24, 2014, now U.S. Pat. No. 9,022,527, which claims priority to Japanese Patent Application No. 2013-065757 filed Mar. 27, 2013, the entireties of which are expressly incorporated herein by reference.

BACKGROUND

1. Technical Field

The present invention relates to a liquid ejecting head and a liquid ejecting apparatus.

2. Related Art

As a liquid ejecting head that ejects a liquid, an ink jet type recording head is known in which a piezoelectric element (actuator device) is provided on one surface of a flow channel formation substrate in which a pressure chamber communicating with a nozzle is provided and in which an ink droplet is discharged from the nozzles by performing pressure fluctuation in the pressure chamber by displacement of the piezoelectric element.

As the ink jet type recording head, there is a head in which a COF substrate (wiring substrate) that supplies a drive signal is inserted to a through-hole by attaching a protective substrate having the through-hole in which the piezoelectric element is exposed, to the flow channel formation substrate, and the COF substrate is connected to the piezoelectric element via a lead electrode (for example, refer to JP-A-2011-025493). The COF substrate and the lead electrode are connected to each other in the through-hole by an anisotropic conductive paste (ACP). The ACP is configured to have conductive particles and a paste, and there is a case where insulation is applied to the paste.

Performing a highly dense formation of nozzles by narrowing a pitch of the nozzles more has been sought in recent years, but if the COF substrate and the lead electrode are connected to each other by the ACP described in JP-A-2011-025493, there is a case of being deviated from a wiring portion since conductive particles contained in the ACP are bigger than a wiring width. Accordingly, there is a problem in that it is difficult to proceed with the highly dense formation of the nozzles.

SUMMARY

Moreover, such a problem is present not only in a liquid ejecting head which ejects a liquid other than an ink but also in an ink jet type recording head.

An advantage of some aspects of the invention is to provide a liquid ejecting head and a liquid ejecting apparatus in which the highly dense formation of nozzles can be realized.

A liquid ejecting head according to an aspect to the invention includes a pressure element that applies a pressure to a pressure chamber which communicates with a nozzle which ejects a liquid; and a lead electrode that is joined to a wiring substrate which supplies a driving signal which drives the piezoelectric element, and the pressure element, in which a surface of the lead electrode on the wiring substrate side in a connection region between the lead electrode and the wiring substrate becomes a concavo-convex surface, in which the lead electrode and the wiring substrate are fixed to each other at a periphery of the connection region and at least one portion of a concave portion of the concavo-convex surface of the lead electrode with a non-conductive paste, and in which the lead electrode and the wiring substrate are electrically connected to each other at a convex portion of the concavo-convex surface of the lead electrode on which the non-conductive paste is not present. In the aspect of the invention, in the lead electrode, since the surface of the connection region with the wiring substrate becomes a concavo-convex surface, and thus the concave portion of the concavo-convex surface functions as a clearance groove of the non-conductive paste at the time of crimping the non-conductive paste, it is possible that the lead electrode and the electrode portion are reliably electrically connected to each other by the convex portion, and thus it is possible to realize a highly dense formation of the nozzles.

It is preferable that concavities and convexities be provided on aside of the lead electrode opposite to the wiring substrate in the connection region, and the concavo-convex surface of the lead electrode be formed by the concavities and convexities. It is possible to easily form the concavo-convex surface of the lead electrode by the concavities and convexities. As a result, it is possible that the lead electrode and the electrode portion are reliably electrically connected to each other.

It is preferable that the pressure element include a first electrode, a piezoelectric body layer, and a second electrode, and that the concavities and convexities which are provided on the side of the lead electrode opposite to the wiring substrate in the connection region be formed of at least the same material as the piezoelectric body layer. It is possible to easily form the concavities and convexities by being formed of the same material as the piezoelectric body layer, and thus it is possible to easily form the concavo-convex surface of the lead electrode by the concavities and convexities. As a result, it is possible that the lead electrode and the electrode portion are reliably electrically connected to each other.

The liquid ejecting apparatus according to the aspect of the invention includes any one liquid ejecting head described above. Since it is possible for the liquid ejecting apparatus to perform the highly dense formation of the nozzles in which the lead electrode and the electrode portion are reliably electrically connected to each other, liquid ejecting is high.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the aspect of the invention will be described in detail with reference to the following drawings.

First Embodiment

Figure 1:
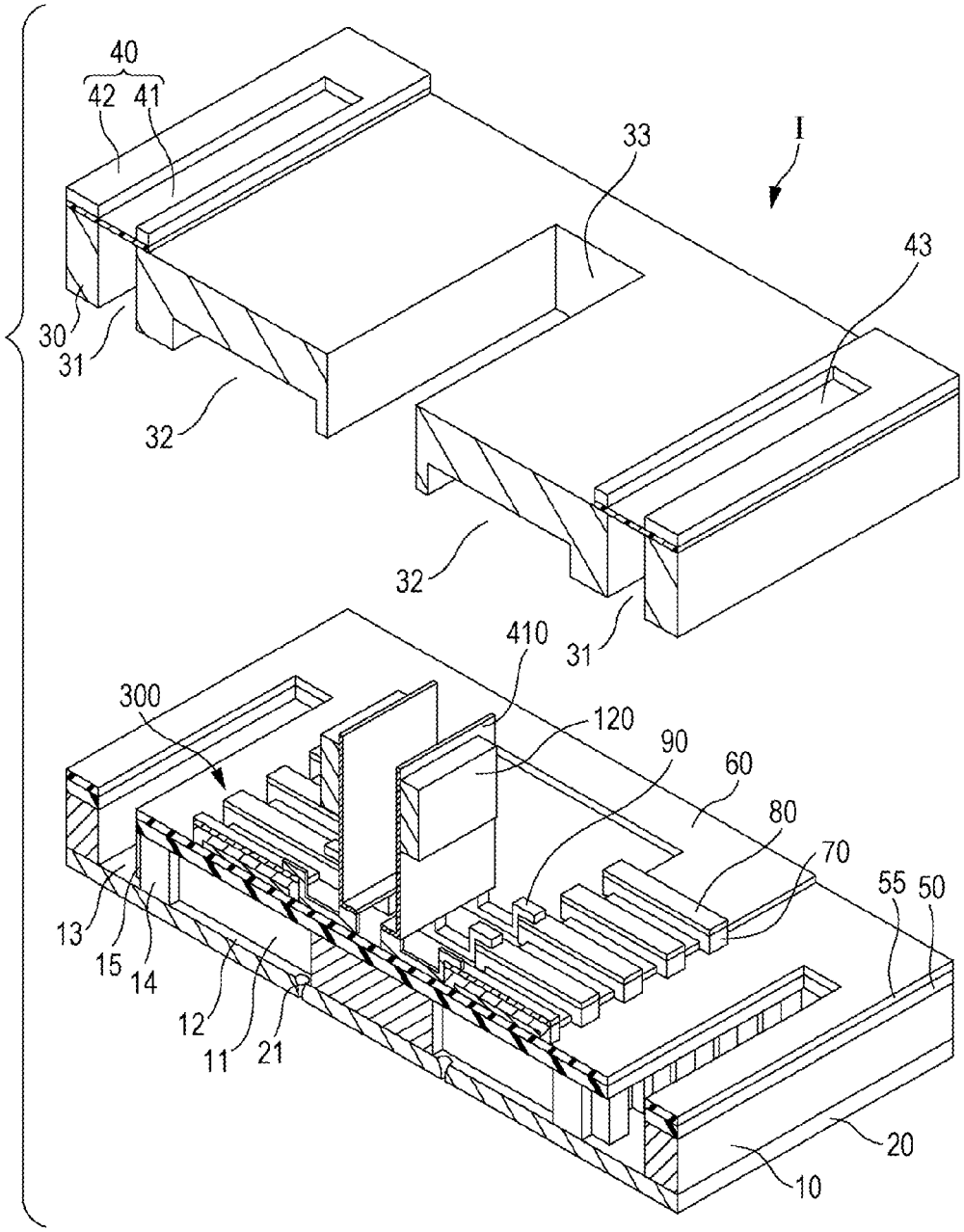
FIG. 1 is exploded perspective views of a recording head according to a first embodiment.
Figure 2A:
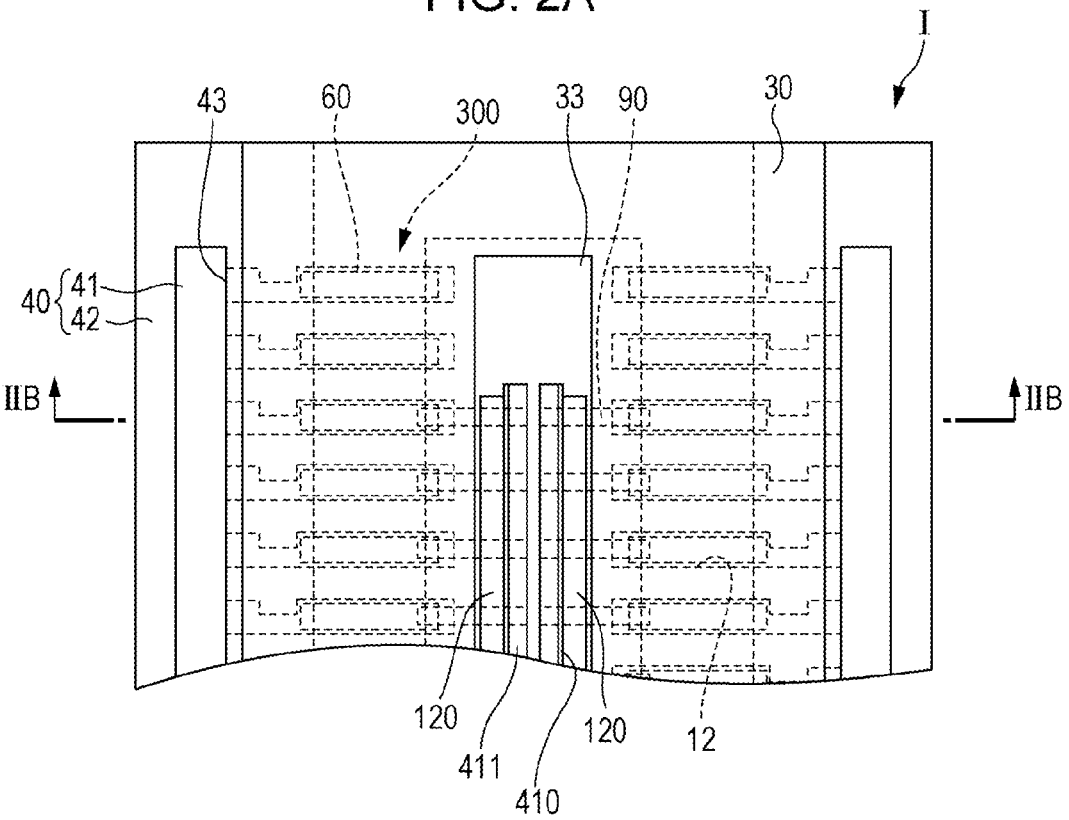
FIGS. 2A and 2B are a plan view and a cross-sectional view of the recording head according to the first embodiment.
Figure 2B:
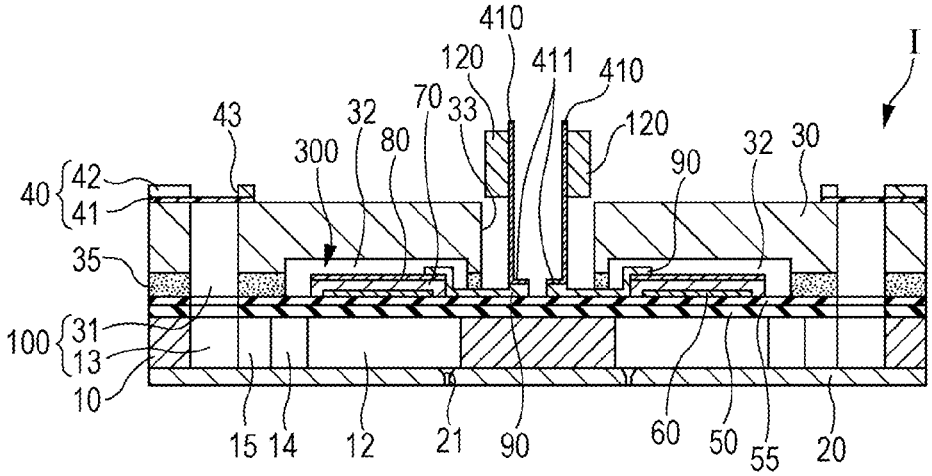
Figure 3:
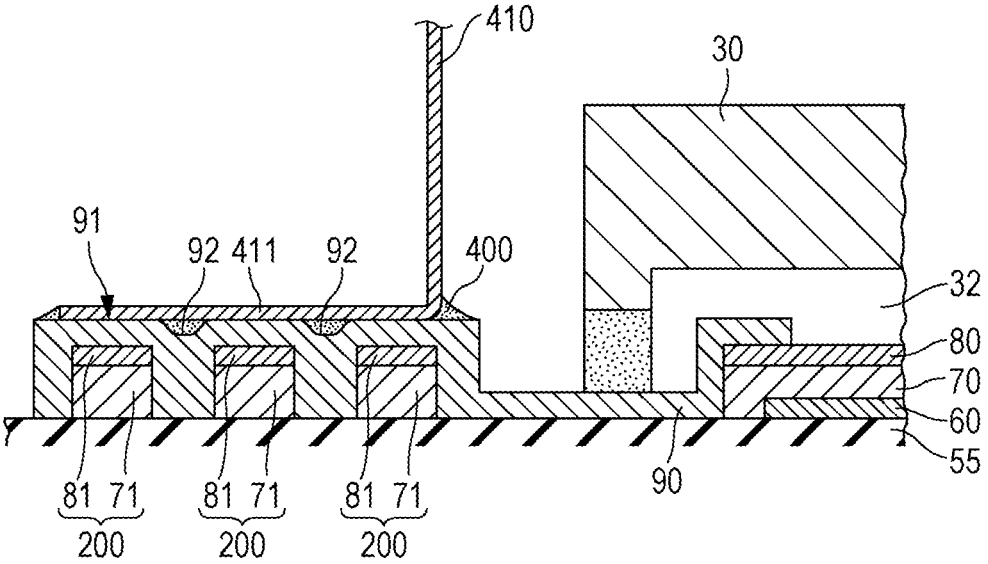
FIG. 3 is an enlarged cross-sectional view of a portion of the recording head according to the first embodiment.
Figure 4:
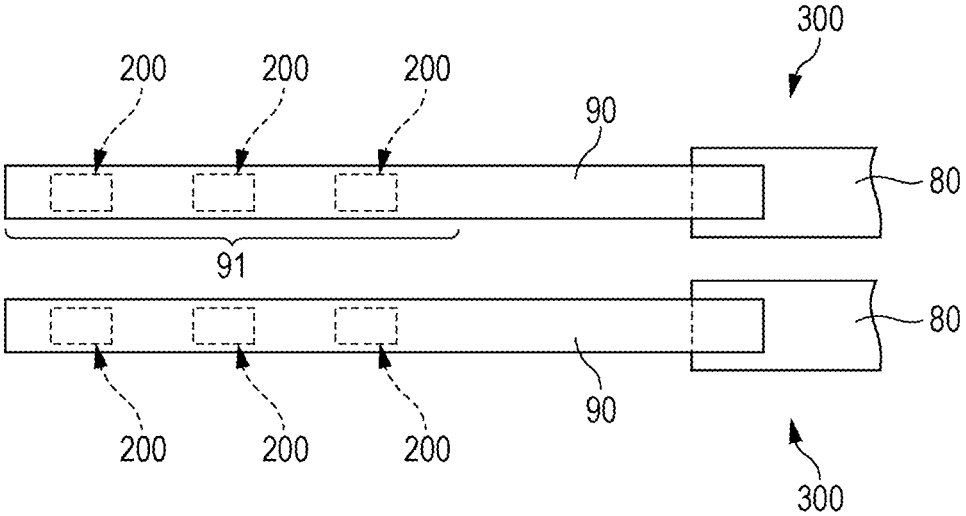
FIG. 4 is an enlarged plan view of main parts of the recording head according to the first embodiment.

FIG. 1 is exploded perspective views showing a schematic configuration of an ink jet type recording head, which is an example of a liquid ejecting head according to a first embodiment of the invention, and FIGS. 2A and 2B are a plan view of FIG. 1 and a cross-sectional view taken along line IIB-IIB thereof. FIG. 3 is an enlarged cross-sectional view of a portion thereof, and FIG. 4 is an enlarged plan view of main parts.

As shown in FIGS. 1 to 4, a flow channel formation substrate 10 is configured of a silicon single crystal substrate, and an elastic film 50 that is configured of a silicon dioxide is formed on one surface of the substrate.

Two lines in which a plurality of pressure generating chambers 12 are arranged in parallel in a width direction are provided on a flow channel formation substrate 10. In addition, a communication portion 13 is formed on an outer side region of the pressure generating chambers 12 of each line in a longitudinal direction, and a communication portion 13 and each pressure generating chambers 12 are communicated with each other via an ink supply channel 14 and a communication passage 15 which are provided for each pressure generating chambers 12.

The communication portion 13 configures a portion of a reservoir 100 becoming a common ink chamber by communicating with a reservoir portion 31 of a protective substrate 30 to be described later for each line of the pressure generating chambers 12. The ink supply channel 14 is formed in a width narrower than the pressure generating chambers 12 and constantly holds a flow channel resistance of the ink flowing into the pressure generating chambers 12 from the communication portion 13. Moreover, in the present embodiment, the ink supply channel 14 is formed by narrowing a width of a flow channel from one surface, but the ink supply channel may be formed by narrowing the width of the flow channel from both sides. In addition, the ink supply channel may be formed by narrowing the flow channel in a thickness direction without narrowing the width of the flow channel. Furthermore, each communication passage 15 is formed by extending barrier ribs 11 of both sides of the pressure generating chambers 12 in the width direction to the communication portion 13 side and by partitioning a space between the ink supply channel 14 and the communication portion 13. In other words, the ink supply channel 14 having a cross-sectional area smaller than a cross-sectional area of the width direction of the pressure generating chambers 12 and the communication passage 15 having a cross-sectional area bigger than a cross-sectional area of the ink supply channel 14 in the width direction while communicating with the ink supply channel 14, which are partitioned by a plurality of barrier ribs 11, are provided in the flow channel formation substrate 10.

In addition, a nozzle plate 20 in which a nozzle opening 21 communicating in the vicinity of the end portion opposite to the ink supply channel 14 of each pressure generating chambers 12 is bored is fixed to an opening surface side of the flow channel formation substrate 10 by a paste or a heat welding film or the like. In the present embodiment, since two lines of the pressure generating chambers in which the pressure generating chambers 12 are arranged in parallel are provided on the flow channel formation substrate 10, and two nozzle lines in which the nozzle openings 21 are arranged in parallel are provided in one ink jet type recording head I. The nozzle plate 20, for example, is configured of glass ceramics, a silicon single crystal substrate, or stainless steel, or the like.

On the other hand, as described above, the elastic film 50 is formed on the opposite side to the opening surface of the flow channel formation substrate 10, and an insulating film 55 is formed on the elastic film 50. Furthermore, a first electrode 60, a piezoelectric body layer 70, and a second electrode 80 are depositedly formed on the insulating film 55 by a process to be described later and configures a piezoelectric element (pressure element) 300. Here, the piezoelectric element 300 refers to a portion including the first electrode 60, the piezoelectric body layer 70 and the second electrode 80. In general, any one of the electrodes of the piezoelectric element 300 is used as a common electrode, and the piezoelectric element is configured by patterning the other electrode and the piezoelectric body layer 70 for each pressure generating chambers 12. Then, here, a portion which is configured of any one of the patterned electrode and the piezoelectric body layer 70 and in which piezoelectric strain occurs by applying voltages to both electrodes is called a piezoelectric body activating portion. In the present embodiment, the first electrode 60 is used as the common electrode of the piezoelectric element 300, and the second electrode 80 is used as an individual electrode of the piezoelectric element 300, but this may be reversed according to the convenience of a driving circuit 120 or wiring. In addition, here, both the piezoelectric element 300 and a vibrating plate in which displacement occurs by the driving of the piezoelectric element 300 are referred to as an actuator device. Moreover, in the above-described example, the elastic film 50, the insulating film 55, and the first electrode 60 operate as vibrating plates, but of course, the configuration is not limited thereto, and for example, only the first electrode 60 may operate as the vibrating plate without providing the elastic film 50 and the insulating film 55. In addition, the piezoelectric element 300 itself may also serve as the vibrating plate in practice. However, in a case where the first electrode 60 is directly provided on the flow channel formation substrate 10, it is preferable to protect the first electrode 60 with an insulating protective film and the like such that the first electrode 60 and the ink are not conductive with each other.

The piezoelectric body layer 70 is configured of a piezoelectric material showing an electro-mechanical conversion action formed on the first electrode 60, particularly, a ferroelectric material having a perovskite structure of the piezoelectric materials. It is preferable to use a crystal film having the perovskite structure as the piezoelectric body layer 70, and a ferroelectric material such as lead zirconate titanate (PZT) and a material obtained by adding a metal oxide such as niobium oxide, nickel oxide or magnesium oxide are preferred. With regard to a thickness of the piezoelectric body layer 70, the thickness is formed to be thick enough to present sufficient displacement characteristics by suppressing the thickness such that cracks do not occur in the manufacturing process.

In addition, a lead electrode 90, which is extracted from the vicinity of the end portion opposite to the ink supply channel 14, is extended onto the insulating film 55, and, for example, is configured of gold (Au) and the like is connected to each second electrode 80, which is an individual electrode of the piezoelectric element 300.

The protective substrate 30 having a reservoir portion 31 which configures at least a portion of the reservoir 100 is joined on the flow channel formation substrate 10 on which such a piezoelectric element 300 is formed, in other words, on the first electrode 60, the elastic film 50, and the lead electrode 90 via a paste 35. In the present embodiment, the reservoir portion 31 penetrates through the protective substrate 30 in the thickness direction and is formed over in the width direction of the pressure generating chambers 12 and configures the reservoir 100 which communicates with the communication portion 13 of the above-described flow channel formation substrate 10 and becomes a common ink chamber of each pressure generating chambers 12. In addition, only the reservoir portion 31 may be used as the reservoir by dividing the communication portion 13 of the flow channel formation substrate 10 in a plural number for each pressure generating chamber 12. Furthermore, for example, the ink supply channel 14 which communicates the reservoir 100 and each pressure generating chambers 12 with members (for example, elastic film 50 and insulating film 55 and the like) interposed between the flow channel formation substrate 10 and the protective substrate 30 may be provided by providing the flow channel formation substrate 10 with only the pressure generating chambers 12.

In addition, a piezoelectric element holding portion 32 having a space large enough to prevent the inhibition of the movement of the piezoelectric element 300 is provided in a region opposing the piezoelectric element 300 of the protective substrate 30. The piezoelectric element holding portion 32 may have a space large enough to prevent the inhibition of the movement of the piezoelectric element 300, and the space may be sealed or may not be sealed.

It is preferable to use a material having substantially the same thermal expansion coefficient of the flow channel formation substrate 10, for example, glass, a ceramic material or the like as such a protective substrate 30. In the present embodiment, the protective substrate is formed using a silicon single crystal substrate of the same material as the flow channel formation substrate 10.

In addition, a through-hole 33 penetrating through the protective substrate 30 in the thickness direction is provided on the protective substrate 30. Then, the vicinity of the end portion of the lead electrode 90 extracted from each piezoelectric element 300 is provided so as to face the inner side of the through-hole 33.

In the ink jet type recording head I according to the present embodiment, since two lines of the pressure generating chambers 12 are arranged on the flow channel formation substrate 10 in parallel, two lines in which the piezoelectric elements 300 are arranged in parallel in the width direction (width direction of piezoelectric element 300) of the pressure generating chambers 12 are arranged in parallel. In other words, two lines of the pressure generating chambers 12, the piezoelectric elements 300, and the lead electrodes 90 are provided to be opposite to each other.

The driving circuit 120 for driving each piezoelectric element 300 is mounted on a COF substrate 410, which is a print substrate. Respective lower end portions 411 of each COF substrate 410 are connected to the end portion of the lead electrode 90 and each COF substrate is substantially vertically stood. A plurality of terminals (not shown) are provided in the lower end portion 411. The lower end portion 411 of the COF substrate 410 and the end portion of the lead electrode 90 are directly joined (contacted), and thus electrically connected to each other. A region where the lower end portion 411 of the COF substrate 410 is directly joined out of the end portions of the lead electrode 90 is used as a junction region 91.

A plurality of protruding portions (concavity and convexity) 200 (three in the present embodiment) are formed on the insulating film 55 corresponding to the junction region 91. As shown in FIG. 4, each protruding portion 200 is separated from the piezoelectric element 300 and is provided so as to be separated from each other in an island shape respectively. The three protruding portions 200 are configured of the piezoelectric body layer 71 and the second electrode 81 which are provided so as to be separated from the piezoelectric element 300 respectively. That is, the three protruding portions 200 are simultaneously formed, which will be described later, at the time of forming the piezoelectric body layer 70 and the second electrode 80. Accordingly, the protruding portion 200 is configured of the same material as the piezoelectric body layer 70.

In this manner, as the three protruding portions 200 are formed, a convex portion of a concavo-convex surface is formed on the protruding portion 200 and a concave portion (concave portion of concavo-convex surface) 92 is respectively formed between the convex portions in the junction region 91 of the lead electrode 90 formed on the protruding portions 200.

Here, the junction region 91 between the lower end portion 411 of the COF substrate 410 and the lead electrode 90 is fixed at a periphery of the junction region 91 by a non-conductive paste (hereinafter referred to as NCP) 400. Since the NCP 400, the non-conductive paste, is not present in the junction surface between the COF substrate 410 and the junction region 91 of the lead electrode 90 and is present in the periphery of the junction region 91 and the concave portion 92, the junction surfaces between the lower end portion 411 of the COF substrate 410 and the junction region 91 of the lead electrode 90 are electrically connected to each other in the present embodiment. As will be described in detail later, but in the present embodiment, it is possible to reliably electrically connect the lower end portion 411 of the COF substrate 410 and the junction region 91 of the lead electrode 90 by forming the concave portion 92 in the junction region 91 of the lead electrode 90 during pasting of the NCP 400 as the NCP 400 moves to the concave portion 92. That is, the concave portion 92 functions as a clearance groove and the convex portion formed on the protruding portion 200 is connected to the lead electrode 90.

In this manner, in the present embodiment, it is possible to perform the highly dense formation of the nozzles by joining the COF substrate 410 and the lead electrode 90 by the NCP 400 as compared with a case where the ACP is used. In this case, it is possible to suppress a contact failure by forming the concave portion 92 in the junction region 91 without leaving the NCP 400 on the junction surface between the COF substrate 410 and the lead electrode 90. Accordingly, it is possible to respond to a demand for the highly dense formation of the nozzles according to a structure of the present embodiment.

Referring back to FIGS. 1 to 2B, a compliance substrate 40 configured of a sealing film 41 and a fixing plate 42 is joined on the protective substrate 30. Here, the sealing film 41 is formed of a material with low rigidity with flexibility (for example, polyphenylene sulfide (PPS) film) and one side of the reservoir portion 31 is sealed by the sealing film 41. In addition, the fixing plate 42 is formed of a hard material such as a metal (for example, stainless steel (SUS) and the like). Since a region opposing the reservoir 100 of the fixing plate 42 becomes the opening portion 43 which is completely removed in the thickness direction, one surface of the reservoir 100 is sealed only by the sealing film 41 having flexibility.

In the ink jet type recording head according to the above-described present embodiment, the ink is captured from an ink inlet connected to an external ink supply unit (not shown), and the inner side from the reservoir 100 to the nozzle opening 21 is filled with the ink. Then, recording signals from the driving circuit 120 are input via the COF substrate 410 and the lead electrode 90, a voltage is applied between each first electrode 60 and each second electrode 80, which correspond to the pressure generating chambers 12, a pressure within each pressure generating chambers 12 is increased by causing the elastic film 50, the insulating film 55, the first electrode 60, and the piezoelectric body layer 70 to be flexibly deformed, and the ink droplet is ejected from the nozzle opening 21.

Hereinafter, description will be given with regard to a method of manufacturing such an ink jet type recording head I.

Figure 5A:
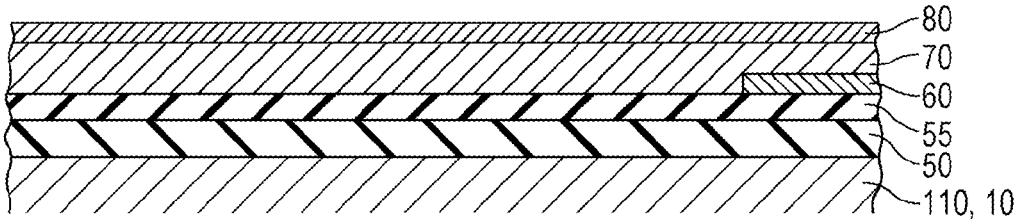
FIGS. 5A to 5C are cross-sectional views showing a manufacturing process of the recording head according to the first embodiment.

First, as shown in FIG. 5A, the elastic film 50 on a surface of a wafer 110, a silicon wafer, for the flow channel formation substrate, and then the insulating film 55 formed of zirconium oxide is formed on the elastic film 50. Subsequently, the first electrode 60 is formed, for example, by a sputtering method on a whole surface on the insulating film 55 and the first electrode 60 is patterned by dry etching such as ion milling. Next, in the present embodiment, the piezoelectric body layer 70 formed of lead zirconate titanate (PZT) is formed. It is possible to form the piezoelectric body layer 70, for example, by liquid phase method. Then, the second electrode 80 is formed on a top surface of the piezoelectric body layer 70. Moreover, it is possible to form the second electrode 80 by a sputtering method or PVD method (physical vapor deposition).

Figure 5B:
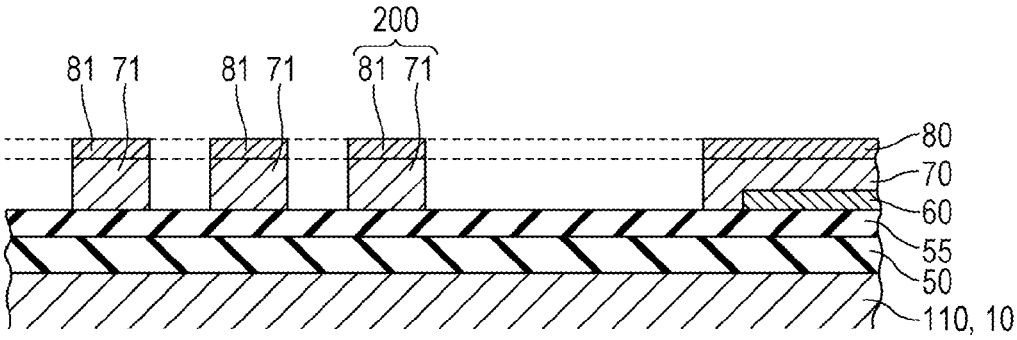

Then, as shown in FIG. 5B, both the piezoelectric body layer 70 and the second electrode 80 are patterned. In the case, the protruding portion 200 is formed by separating the piezoelectric body layer 70 from the second electrode 80, which configure the piezoelectric element 300 and leaving the piezoelectric body layer 71 and the second electrode 81 in an island shape.

Figure 5C:
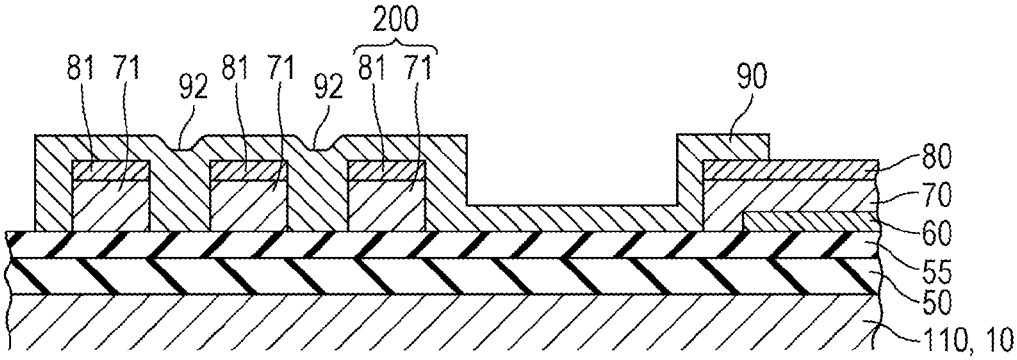

Next, as shown in FIG. 5C, the lead electrode 90 is formed on the protruding portion 200, thereby forming the concave portion 92 on the surface of the junction region 91 of the lead electrode 90.

Thereafter, although not shown in the drawing, the wafer for the protective substrate, a silicon wafer, configured of a plurality of protective substrates 30 is joined via the paste, and the wafer 110 for the flow channel formation substrate is thinned to a predetermined thickness, and furthermore the pressure generating chambers 12, the ink supply channel 14, the communication passage 15, and the communication portion 13 and the like, which correspond to the piezoelectric element 300, are formed in the piezoelectric element 300 side of the wafer 110 for the flow channel formation substrate. Then, unnecessary portions of outer peripheral edge portions of the wafer 110 for the flow channel formation substrate and the wafer for the protective substrate are removed by cutting using dicing and the like. Subsequently, while the nozzle plate 20 in which nozzle opening 21 is bored is joined on the surface opposite to the wafer 110 for the flow channel formation substrate and the wafer for the protective substrate, the compliance substrate 40 is joined to the wafer for the protective substrate, and the wafer 110 for the flow channel formation substrate and the like are divided into one chip-sized flow channel formation substrate 10 and the like, which are shown in FIG. 1.

Figure 6A:
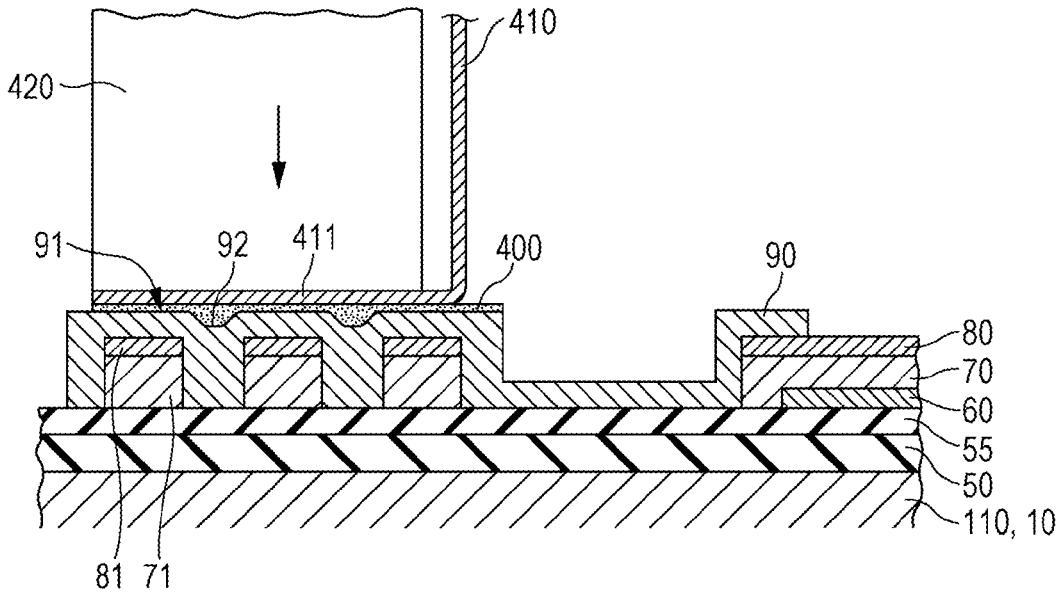
FIGS. 6A and 6B are cross-sectional views showing a manufacturing process of the recording head according to the first embodiment.
Figure 6B:
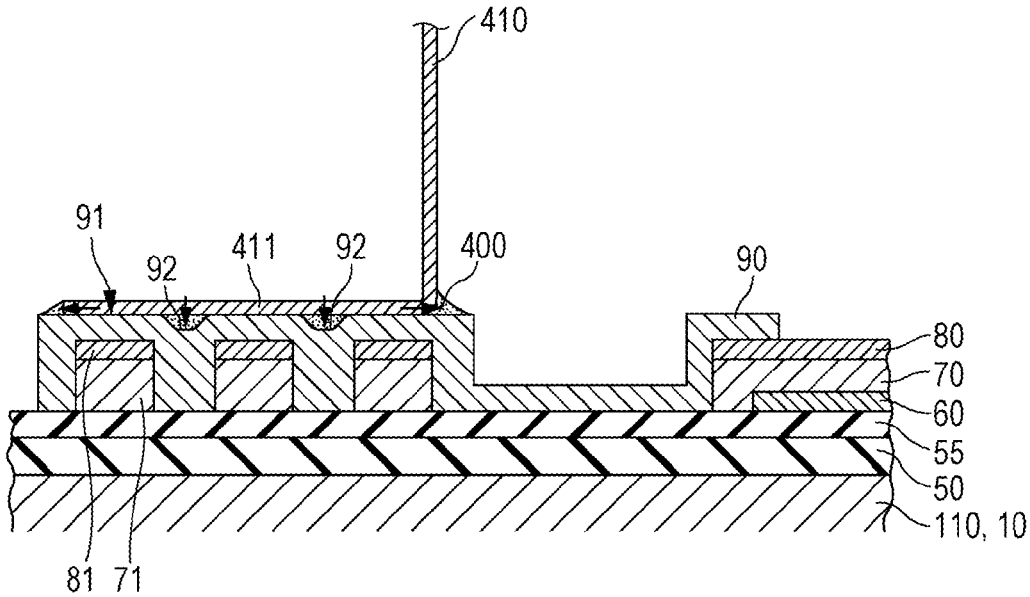

Then, as shown in FIG. 6A, the NCP 400 is applied between the junction region 91 of the lead electrode 90 and the lower end portion 411 of the COF substrate 410 and is pressurized by a crimping tool 420 while being heated. As a result, as shown in FIG. 6B, the junction region 91 of the lead electrode 90 and the lower end portion 411 of the COF substrate 410 are joined by moving the NCP 400 from the junction region 91 to the periphery of the junction region 91 and the concave portion 92 at the time of crimping. Accordingly, each terminal formed on the lower end portion 411 of the COF substrate 410 and the junction region 91 are joined in a state of being in direct contact, and each terminal and the junction region 91 are fixed at the periphery of the junction region 91 by the eliminated NCP 400.

That is, in a case where the lower end portion 411 of the COF substrate 410 and the lead electrode 90 are joined using the NCP 400, while electrical connection is attained by directly crimping the junction region 91 and the terminal of the lower end portion 411 of the COF substrate 410, both of the junction region and the lower end portion are fixed at the periphery of the junction region 91 by a resin paste.

Then, in this case, it is possible that the NCP 400 moves not only to the periphery of the junction surface but also to the concave portion 92 by forming the concave portion 92 in the junction region 91 of the lead electrode 90 at the time of crimping. That is, the concave portion 92 functions as the clearance groove of the NCP 400. As a result, it is possible that the NCP 400 remains on the junction surface between the lower end portion 411 of the COF substrate 410 and the lead electrode 90 and suppresses occurrence of the contact failure.

In the present embodiment, it is possible to perform the highly dense formation of the nozzles by joining the COF substrate 410 and the lead electrode 90 by the NCP 400 as compared with a case where the ACP is used. In this case, it is possible to suppress the contact failure by forming the concave portion 92 in the junction surface without leaving the NCP on the junction surface between the COF substrate and the lead electrode.

Moreover, for example, in a case of the NCP 400 is used, it may be possible to increase the pressure by increasing a load of the crimping tool 420 at the time of crimping so as not to leave the NCP 400 in the junction surface between the lower end portion 411 of the COF substrate 410 and the lead electrode 90, but this is not desirable if considering a case where there is a limit to the increase in pressure and impacts on the recording head I or the crimping tool 420. For this reason, as in the present embodiment, it is preferable to form the clearance groove of the NCP 400 by making the surface of the junction region 91 of the lead electrode 90 concave and convex so as not to leave the NCP 400 on the junction surface and to join the surface of the junction region by the NCP 400 in the recording head in which the nozzles are densified.

In this manner, in the present embodiment, it is possible to easily form the concave portion 92 by the protruding portion 200. Then, since the pressure of the junction region 91 of the lead electrode 90 is relatively increased by providing the concave portion 92, the NCP 400 is more easily removed. As a result, it is possible to easily produce an ink jet type recording head of the present embodiment.

Second Embodiment

Figure 7:
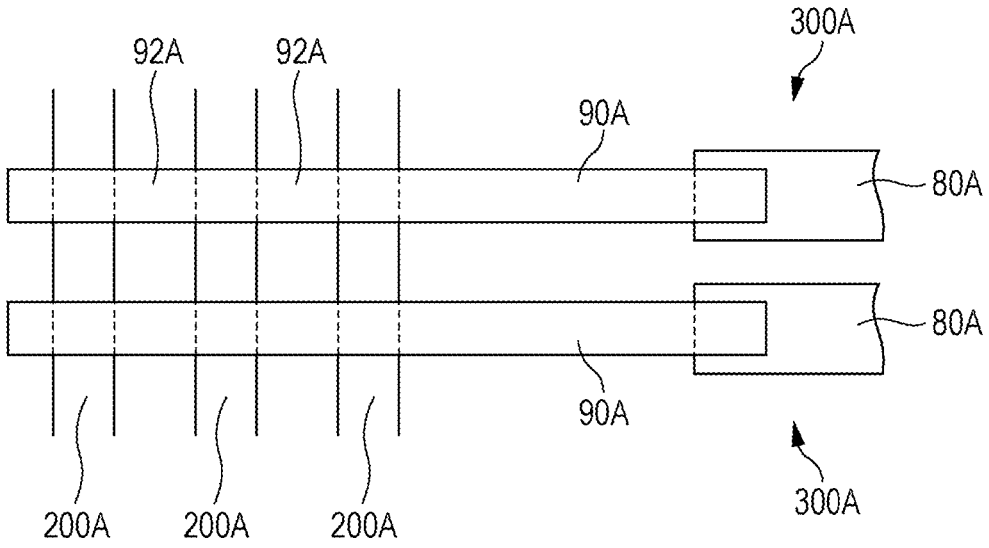
FIG. 7 is an enlarged plan view of main parts of the recording head according to a second embodiment.

In the present embodiment, the shape of the protruding portion is different from the first embodiment. In the present embodiment, as shown in FIG. 7, a protruding portion 200A is a line shape which extends in the direction perpendicular to an extending direction of the lead electrode. A concave portion 92A is formed at an intersection between the protruding portion 200A and the lead electrode 90A.

The line-shaped protruding portion 200A according to the present embodiment can be said to be preferred to the island-shaped protruding portion 200 according to the first embodiment, considering accuracy at the time of etching a second electrode 80A and a piezoelectric body layer 70A.

In this manner, the shapes of the protruding portion 200 and 200A are not limited. The concavities and convexities may be formed on the surface of the junction region 91 of the lead electrode 90. For example, the protruding portion 200 may be other shapes such as a circular shape in a plan view.

Furthermore, in the first and second embodiments, concavities and convexities may be formed on the surface of the junction region 91 of the lead electrode 90, and the structures may be various. It is not necessary to form the protruding portions 200 and 200A by the piezoelectric body layer 71 and the second electrode 81. It is possible to most easily configure the protruding portions 200 and 200A if the protruding portions are configured of the piezoelectric body layer 71 and the second electrode 81, but for example, the protruding portions may be configured of only the piezoelectric body layer 71 or may be configured of the first electrode 60 and the piezoelectric body layer 70. For example, the second electrode 81 may be directly formed on the insulating film 55 and then the lead electrode 90 may be directly formed on the second electrode also in the concave portion without being limited to those in which the lead electrode 90 is directly formed on the insulating film 55. The concavities and convexities may be formed on the surface of the junction region 91 of the lead electrode 90 by forming the concavities and convexities on the surface itself of the flow channel formation substrate 10 or the concavities and convexities may be formed on the surface of the lead electrode 90 by changing the thickness of the surface itself of the lead electrode 90.

Another Embodiment

Hitherto, description is given with regard to embodiments of the invention; however, the basic structure of invention is not limited to the above-described embodiments.

Figure 8:
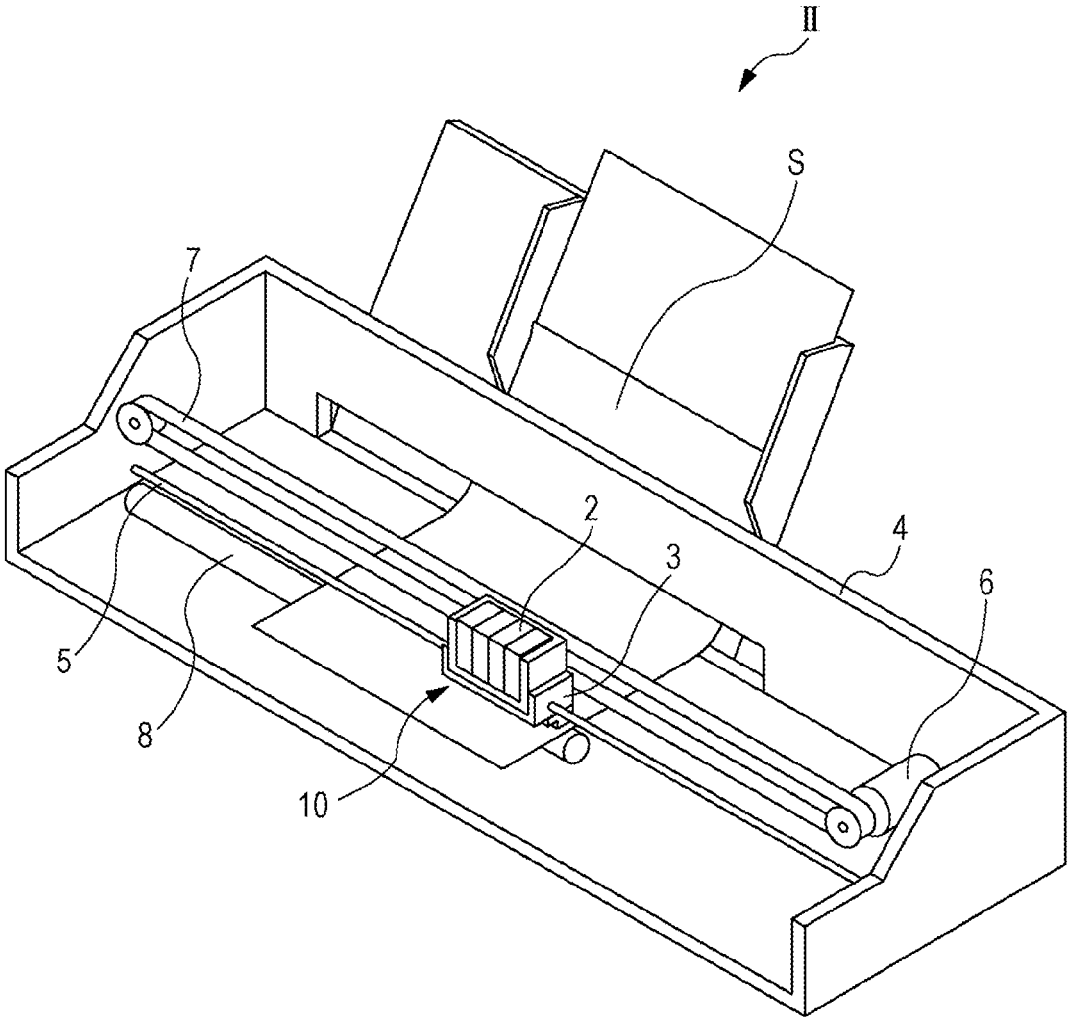
FIG. 8 is a perspective view of a liquid ejecting apparatus according to another embodiment.

For example, the ink jet type recording head I, for example, as shown in FIG. 8, is mounted on an ink jet recoding apparatus II. As shown in FIG. 8, the ink jet type recording apparatus II, for example, includes the recording head I in which an ink cartridge (liquid storage unit) 2 having a storage chamber where a plurality of inks with different colors, for example, black (B), cyan (C), magenta (M), and yellow (Y) and the like are stored is installed. The recording head I is mounted on a carriage 3, and the carriage 3 on which the recording head I is mounted is provided axially movably on a carriage shaft 5 attached to an apparatus main body 4. Then, the carriage 3 is moved along the carriage shaft 5 by transmitting a driving force of a driving motor 6 to a carriage 3 via a plurality of gears (not shown) and a timing belt 7. On the other hand, a platen 8 is provided along the carriage shaft 5 in the apparatus main body 4, and a recording medium S such as paper fed by a feeding apparatus (not shown) is transported on the platen 8.

Moreover, the ink jet type recording apparatus II is exemplified as an apparatus in which the recording head I is mounted on the carriage 3 and moves in a main scanning direction, but is not particularly limited to this. For example, it is also possible to apply the invention to a so-called line type recording apparatus in which the recording head I is fixed and printing is performed only by moving a recording sheet such as paper in a sub-scanning direction.

Furthermore, the invention widely aims at the liquid ejecting head in general and can be applied for example to various recording heads such as an ink jet type recording head used in an image recording apparatus such as a printer, a color ejecting head used in the manufacturing of a color filter such as a liquid crystal display, an electrode material ejecting head used in electrode formation such as an organic EL display and a field emission display (FED), and a bio-organic material ejecting head used in the manufacturing of a bio-chip, and the like.

What is claimed is:

1. A liquid ejecting head for ejecting a liquid, the liquid ejecting head comprising:

a pressure element for ejecting the liquid from a nozzle;

a lead electrode for transmitting a driving signal to the pressure element; and a wiring substrate for transmitting the driving signal to the lead electrode;

wherein the lead electrode and the wiring substrate are connected at a junction region, the lead electrode has a concavo-convex surface made of a concave portion and a convex portion at the junction region, and a non-conductive paste is arranged at the concave portion and a periphery of the junction region for fixing the lead electrode and the wiring substrate.

2. The liquid ejecting head according to claim 1, further comprising:

a piezoelectric body layer having a concave portion and a convex portion below, and corresponding to, the concave portion and the convex portion respectively of the concavo-convex surface.

3. A liquid ejecting apparatus comprising:

the liquid ejecting head according to claim 1.

4. A liquid ejecting apparatus comprising:

the liquid ejecting head according to claim 2.

5. A piezoelectric device comprising:

a piezoelectric element;

a lead electrode in communication with the piezoelectric element; and a wiring substrate in communication with the lead electrode at a junction region;

wherein the lead electrode has a concavo-convex surface made of a concave portion and a convex portion at the junction region, and a non-conductive paste is arranged at the concave portion and a periphery of the junction region for fixing the lead electrode and the wiring substrate.

6. The piezoelectric device according to claim 5, further comprising:

a piezoelectric body layer having a concave portion and a convex portion below, and corresponding to, the concave portion and the convex portion respectively of the concavo-convex surface.

7. A manufacturing method for a piezoelectric device, comprising:

providing a lead electrode which has a concavo-convex surface comprising a concave portion and a convex portion for communicating with a piezoelectric element;

providing a wiring substrate for communicating with the lead electrode;

providing a non-conductive paste between the concavo-convex surface of the lead electrode and the wiring substrate at a junction portion of the lead electrode and the wiring substrate; and pressing the wiring substrate and the lead electrode to move the non-conductive paste to the concave portion and a periphery of the junction portion.

8. The manufacturing method for a piezoelectric device according to claim 7, further comprising:

forming a piezoelectric body layer;

forming a layer of electrode on the piezoelectric body layer;

patterning the piezoelectric body layer and the layer of the electrode to make a plurality of protruding portions; and forming the lead electrode over the plurality of protruding portions to shape the concavo-convex surface of the lead electrode.

* * * * *